US008407925B2

(12) United States Patent
Fesas

(10) Patent No.: US 8,407,925 B2
(45) Date of Patent: Apr. 2, 2013

(54) FIREARM RECEIVER COVER HAVING AN ACCESSORY MOUNT

(76) Inventor: Nelson A. Fesas, Austin, TX (US)

( * ) Notice: Subject to any disclaimer, the term of this patent is extended or adjusted under 35 U.S.C. 154(b) by 0 days.

(21) Appl. No.: 12/916,257

(22) Filed: Oct. 29, 2010

(65) Prior Publication Data

US 2012/0102804 A1 May 3, 2012

(51) Int. Cl.
*F41C 23/00* (2006.01)

(52) U.S. Cl. ..... 42/124; 42/90; 42/75.01

(58) Field of Classification Search ..... 42/124, 42/71.02, 71.01, 72, 75.03; 89/41.17
See application file for complete search history.

(56) References Cited

U.S. PATENT DOCUMENTS

| | | | |
|---|---|---|---|
| 4,845,871 | A | 7/1989 | Swan |
| 5,343,650 | A | 9/1994 | Swan |
| 5,522,166 | A | 6/1996 | Martel |
| 5,595,011 | A | 1/1997 | Gorslin |
| 6,381,895 | B1 | 5/2002 | Keeney et al. |
| 6,854,206 | B2 | 2/2005 | Oz |
| 7,062,876 | B2 | 6/2006 | Wilson |
| 7,076,907 | B2 | 7/2006 | Nesseth et al. |

*Primary Examiner* — Daniel J Troy
(74) *Attorney, Agent, or Firm* — Gregory K. Goshorn; Greg Goshorn, P.C.

(57) ABSTRACT

An adjustable receiver cover for a firearm having an integral accessory mounting structure and pivotally attached to the firearm. A front mounting tab adjustably attached to the cover body accommodates physical variances between examples of said firearm. The front of adjustable cover is pivotally attached to the firearm by a pin. The adjustable cover is firmly affixed at its rear by a cam locking release button. The adjustable cover is self centering by means of an integral spring apparatus.

22 Claims, 6 Drawing Sheets

FIREARM RECEIVER COVER HAVING AN ACCESSORY MOUNT

BACKGROUND OF THE INVENTION

The present subject matter relates to the field of firearms and an integration means, and more particularly to a receiver cover apparatus for securing accessories such as optical sights to firearms.

A constant set of goals for firearms operators is improved accuracy, quicker target acquisition, and improved low light shooting capability. The standard mechanical or iron sights commonly provided on firearms, while simple, effective, and reliable, are generally inadequate for long range precision shooting, take time to properly align with a target, and work poorly in low light conditions. As the field of military and civilian firearms progresses, numerous add-on enhancements have become available for attachment to standard firearms to satisfy the aforementioned goals thereby upgrading the capability of firearms.

The add-on enhancements present their own set of problems when integrating to firearms. A common, although not exclusively used, integration means is the MIL-STD-1913 interface rail commonly known as a Picatinny rail. These integration means offer only a partial attachment solution at the interface between the accessory and firearm. As the inventor has herein realized a further and more complete mounting solution is generally required to integrate the aforementioned interface solutions to a substantial and stable structure of the firearm.

BRIEF SUMMARY OF THE INVENTION

The claimed subject matter, while generally applicable to firearms and not limited in scope to any single type of firearm, for purposes of description will be herein described as relating to an AK-47 type rifle. Operators of AK-47 type rifles, which are well known and will not be described in substantial detail herein, are faced with unique problems in the integration of optic mounts to said rifles. For example, the design of the AK-47 type rifle is intended for reliability, simplicity, and ease of manufacture. The configuration of an AK-47 type rifle includes easy to disassemble components for field stripping, cleaning, and maintenance and is not primarily designed for optic mounting. The conventional method of optic mount attachment by drilling and tapping the top surface of the rifle receiver to accept conventional scope rings is not possible on the AK-47 type rifle due to the removable receiver cover. Mounting of optics to removable parts of the rifle is a common yet inadequate solution as the removable parts are not firmly affixed and stationary relative to the rifle.

A common solution for the AK-47 type rifle is to attach an optic mount bracket to the side of the receiver. While this solution does provide a rigidly affixed optic mount it introduces problems of its own. In order to preserve the field stripping capability of the rifle the optic mounting surface of the bracket is located substantially above the receiver cover to allow for removal of internal components. This location of mounting surface raises the centerline of the optic well above the normal aiming line of sight. The high mounted optic then prevents the operator from obtaining an accurate, consistent, and comfortable cheek weld with the buttstock of the rifle and frequently requires placement of the buttstock under the operator's chin when aiming.

Another common problem with optic mounts attached to the side of the receiver is an off center location of the optic causing an undesirable offset in point of aim. A further common problem with tall optic mounts attached to the side of the receiver is the inability to simultaneously co-witness the standard iron sights through the lens of an unmagnified type optic. The herein identified problems with side mounted brackets have been addressed to some degree by shorter side mount brackets equipped with a quick release mechanism for removal of the bracket during field stripping. These quick release brackets are known, however, for not precisely returning to their point of aim or "zero" and requiring adjustment and realignment after each removal and installation.

The above problems are addressed to a degree by Keeney et al. in U.S. Pat. No. 6,381,895. Keeney makes use of an optic mount affixed to or integrally formed with the operating rod gas tube of an ak-47 type rifle and simultaneously affixed to the barrel of the rifle. While this solution addresses the problems of a stationary mount, properly centered, low mounted allowing co-witness of optics, and not disturbed by field stripping it does introduce other problems. Of greatest concern being the large amount of heat transferred from the barrel and gas tube directly into the optic. The level of heat transfer to the optic device is known to frequently destroy electrically powered optics.

A second problem with Keeney is the placement of the optic mount over the forward hand guard area of the rifle and at a substantial distance from the operator's eye limits the available optic choices. This results from the requirement of most magnified optics to be located relatively close to the operator's eye. Furthermore, the added weight of an optic at the far forward end of the rifle creates a negative effect on the balance and handling of the rifle.

The above problems have also been addressed to a degree by Gorslin in U.S. Pat. No. 5,595,011. Gorslin does address the issues of a stationary mount, well centered, and not affected by field stripping. However, an aspect in Gorslin that is considered in the patent as an advantage is the placement of the optic mount substantially above the line of sight of the iron sights to permit the alternate use of either optic or iron sights. Gorslin thereby introduces the same ergonomic problems of the aforementioned side mounted optic mount bracket.

Furthermore in Gorslin, the optic is mounted so far forward on the barrel that the balance of the firearm is substantially negatively affected. The extreme forward optic placement also exposes the optic to physical harm due to accidental blows as the firearm is carried in field conditions.

The inventor, as herein described, has realized a need has remained for an optic mount for rifles with a receiver cover, including but not limited to AK-47 type rifles, that is carried low on the rifle to permit the simultaneous use of optic sights and the standard iron sights, properly centers the optic relative to the rifle, is firmly affixed to and stable relative to the rifle, and permits field stripping of the rifle without disturbing the optic zero or setting.

The inventor, as herein described, has realized a need has also remained for an optic mount for rifles with a receiver cover, including but not limited to AK-47 type rifles, that requires no significant modifications to the rifle and readily accommodates physical variances between examples of said rifles.

The inventor, as herein described, has realized a further need has remained for an optic mount for rifles with a receiver cover, including but not limited to AK-47 type rifles, that places the optic over the receiver of the rifle where it is protected from barrel or gas tube heat, promotes better balance and handling, and protects the optic from physical damage by being kept near the operator's body when carried in the field.

The disclosed subject matter provides an adjustable receiver cover (hereinafter adjustable cover) for a firearm having a receiver cover and which may be used as a replacement cover requiring no significant modifications to the firearm when used as a replacement cover for a firearm with a pre-existing receiver cover. The adjustable cover includes a structure and surface for easily mounting optics and accessory devices. The incorporation of the optic and accessory mounting surface integrally with the replacement cover permits the lowest possible placement of the mounting surface above the receiver for best relationship between the rifle and optics and thusly the ergonomic characteristics and handling balance of the rifle. The subject matter provides an attachment and a fixation means for preventing unwanted movement of the receiver cover thereby assuring consistency of aim when used in combination with optics or other aiming accessory devices.

The adjustable cover provides a front (towards muzzle) portion adjustable for overall length, an outer body surface to enclose at least a portion of the interior of the rifle receiver, a low situated optic and accessory mounting surface to minimize sighting obstruction, a self centering spring apparatus to assure positional repeatability of the adjustable cover relative to the rifle receiver, and a rear (towards buttstock) situated cam locking apparatus to fixedly secure the replacement cover to the rifle receiver, thereby minimizing shift and inaccuracy of the optic aiming device during rifle handling and firing.

The adjustable cover includes a principally longitudinal outer body surface extending between opposite ends of the receiver cover and encloses at least a portion of the interior of the rifle receiver while providing openings adequate for the ejection of spent cartridges, operation of a charging handle, and operation of a safety lever. The top surface of the adjustable cover incorporates a step down distance from the uppermost surface of the forward extending longitudinally adjustable mounting tab to the uppermost surface of the adjustable cover body. The step down distance places the optic as low as possible to enable simultaneous co-witnessing of iron sights and optical devices, and also optimizes ergonomics of the rifle when aiming. The upper surface of the adjustable cover body incorporates an integral optic and accessory mounting interface of the type Mil-Std-1913 Picatinny rail or other type rail interface as known to those skilled in the art.

The adjustable cover includes a longitudinally adjustable front mounting tab affixed to the cover by means of screws passing through one or more slots. The front mounting tab incorporates a transverse hole at the forward end for accepting a hinge pin for attachment of the replacement cover to the rifle. The hinge pin may be retained in the rifle assembly by a clip, a pin or wire passing through a cross drilled hole, a pressed on sleeve, a threaded nut assembled onto a threaded end, or by any other means commonly known to those skilled in the art.

A self centering characteristic of the adjustable cover is achieved by employing the material resiliency of one side panel of the cover body as a flexible spring generally pressed against the outer surface of the rifle receiver and employing the opposite side panel of the cover body as a fixed anchor point pressed against the receiver and establishing a repeatable lateral location relative to the rifle receiver. Spring tension and location of the such used side panel is achieved by providing at least one slot, opening, flexure or combination thereof on either side of a protrusion from the inner surface of the spring side panel and thereby controlling the length and force of spring to a desired location and magnitude. The inner surface protrusion of the springing side panel makes contact with an outer side wall of the rifle receiver thereby causing an outward flexing of the spring panel and thusly drawing the opposite inner side panel surface of the replacement cover against the rifle receiver.

The adjustable cover includes a closed rear end comprised of a panel with an opening wherein the bottom edge of the opening interacts with a cam surface incorporated as part of the cover release button. The cover release button being vertically and laterally restrained, and longitudinally free to move by fitment into a mounting slot in the rifle and being under continuous rearward pressure by a spring, exerts a downward force upon the replacement cover at the point of interface between the release button and cover body.

BRIEF DESCRIPTION OF THE SEVERAL VIEWS OF THE DRAWING

A better understanding of the claimed subject matter can be obtained when the following detailed description of the disclosed embodiments is considered in conjunction with the following figures, in which:

DETAILED DESCRIPTION OF THE INVENTION

The claimed subject matter, while generally applicable to firearms and not limited in scope to any single type of firearm, for purposes of description will be herein described as relating to an AK-47 type rifle. Numerous configurations of the AK-47 type rifle are commercially available throughout the world. The typical AK-47 type rifle is well known and will not be described in substantial detail herein and will be hereinafter referred to as rifle.

The present subject matter describes an adjustable receiver cover, hereinafter adjustable cover, for a rifle having a receiver cover. The adjustable cover is configured to require no significant alteration to the rifle when fitted in replacement of a pre-existing conventional receiver cover. The adjustable cover includes an integral structure and surface for easily mounting optics and accessory devices. The incorporation of the optic and accessory mounting surface integrally with the adjustable cover permits the lowest possible placement of the mounting surface for best relationship between the rifle and optics and thusly the ergonomic characteristics and handling balance of the rifle. The subject matter provides an adjustable attachment and a fixation means for preventing movement of the adjustable cover relative to the rifle receiver thereby assuring consistency of aim when used in combination with optics or other aiming devices.

In the various embodiments the adjustable cover and it's several components may be formed of conventional metal, plastic, or composite materials by such conventional techniques as machining, casting, stamping, forging, or extrusion. Any singular technique or combination thereof may be used to produce the adjustable cover subject matter.

Figure 1:
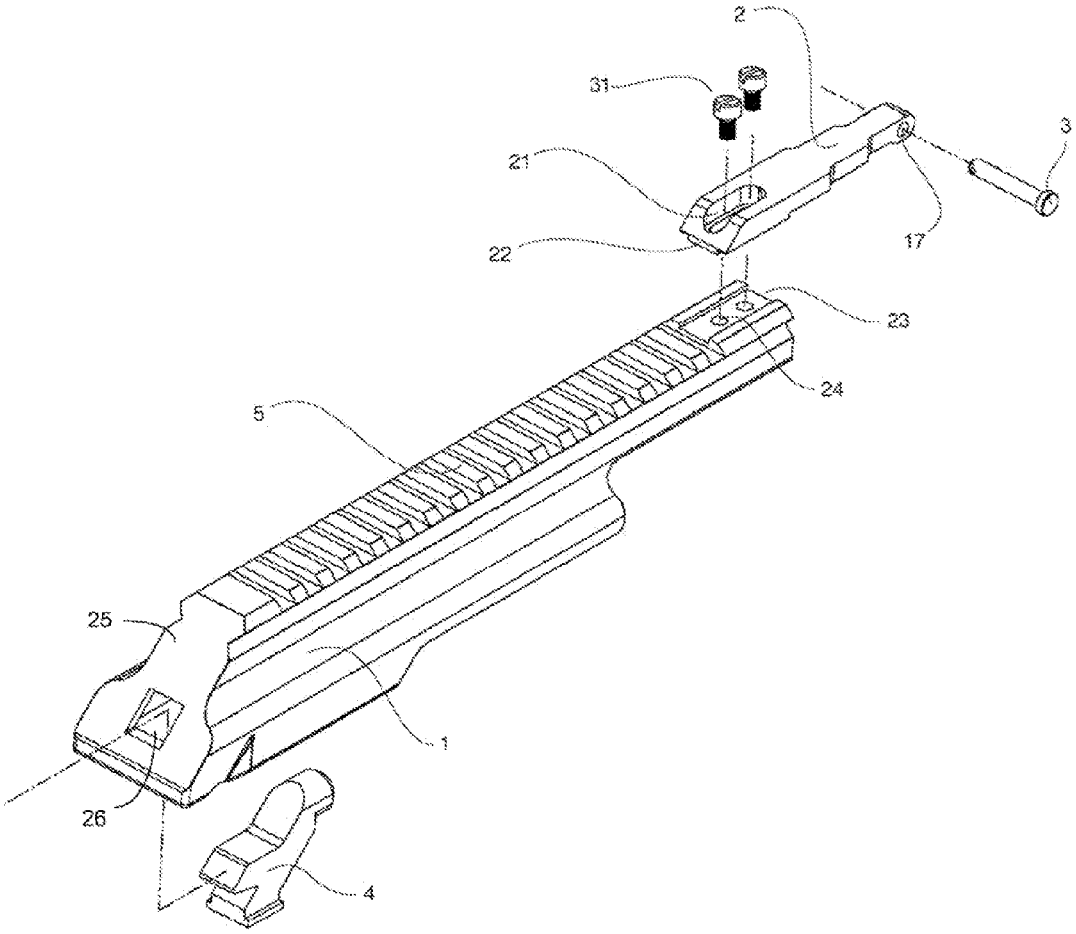
FIG. 1 is an exploded perspective view showing an adjustable receiver cover, as viewed from the right rear side.
Figure 2:
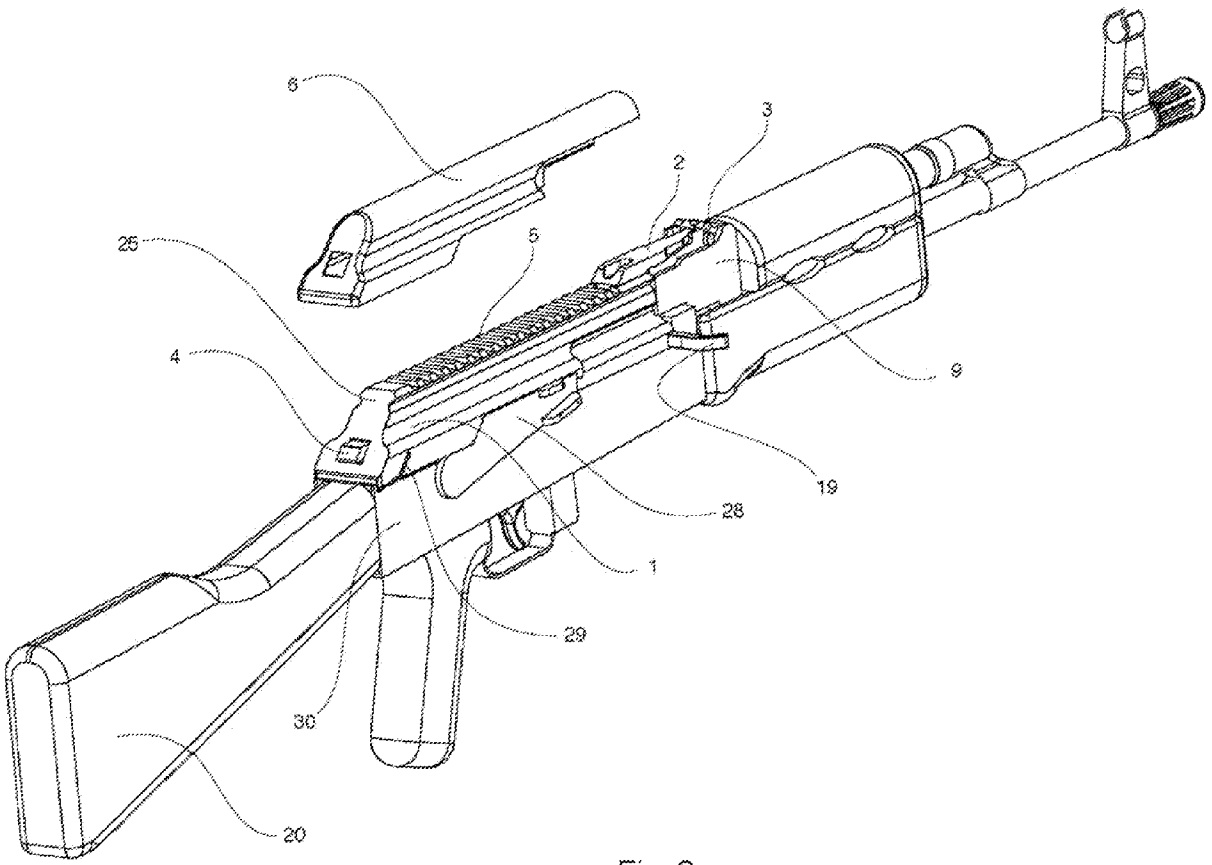
FIG. 2 is a perspective view of an AK-47 type rifle with an attached example of the adjustable receiver cover and a reference example of a standard receiver cover not attached to the rifle as viewed from the right rear.

The adjustable cover subject matter (FIG. 1) provides a cover body 1 to enclose at least a portion of the interior of the rifle receiver 30 (see FIG. 2). An adjustable front mounting tab 2, hereinafter described, accommodates dimensional variance between examples of the rifle. The front tab 2 is secured to the cover body 1 by fasteners 31 passing through counterbored slot 21 and threading into holes 24. The front tab is aligned to the cover body 1 with key 22 and slot 23. A hinge pin 3 passing through hole 17 pivotally attaches the adjustable cover to the rifle. A rear situated earn locking release button 4, hereinafter described, passes through a hole 26 in the cover back panel 25 to tightly secure the adjustable cover to the rifle receiver 30, thereby eliminating undesired shift and inaccuracy of the optic device during rifle handling and firing.

FIG. 2 illustrates the adjustable cover subject matter as installed on the rifle and attached to the rear sight block 9 of the rifle assembly by means of the precise fitting hinge pin 3. The adjustable cover is aligned to the rifle receiver 30 by a spring slot 29, hereinafter described, and secured by the release button 4 passing through back panel 25. A conventional receiver cover 6 of pressed steel manufacture and configuration as normally supplied with the rifle is shown in proximity for comparison. The conventional receiver cover 6 as supplied with the rifle has no front mounting tab and is loosely fitted at its front into a receiving groove in the rear sight block 9 and is loosely attached at its rear by a release button. The generally loose fitment of the conventional receiver cover 6 determines said conventional cover's unsuitability for mounting optics.

The interior cavity of the adjustable cover is so shaped as to provide adequate clearance for the normal operation of the bolt carrier 7 (see FIG. 3) and other interior components of the rifle. The combination of interior and exterior surfaces of the adjustable cover is shaped to be sufficiently close to the adjacent structure and parts of the rifle so as to generally prevent the ingress, to the interior of the rifle, of foreign debris such as stones, plant materials, man made materials, or any other materials as may be commonly encountered in a military or civilian shooting environment.

Figure 4:
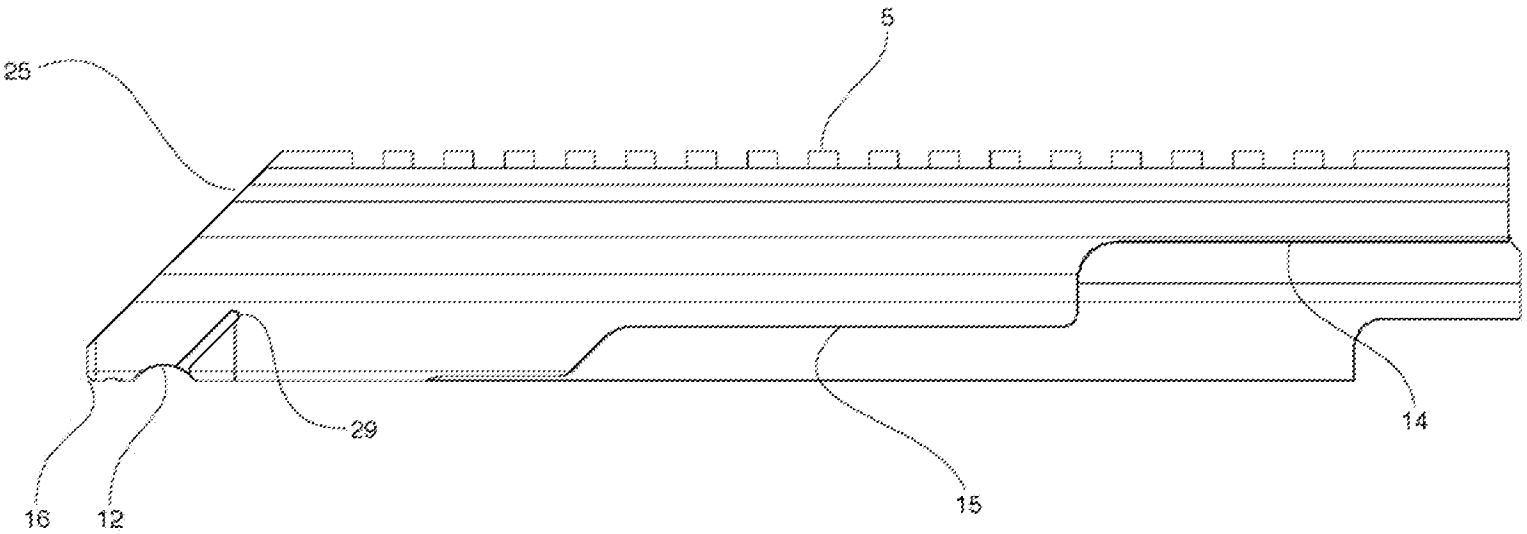
FIG. 4 is a right side elevation view of the adjustable receiver cover body.
Figure 6:
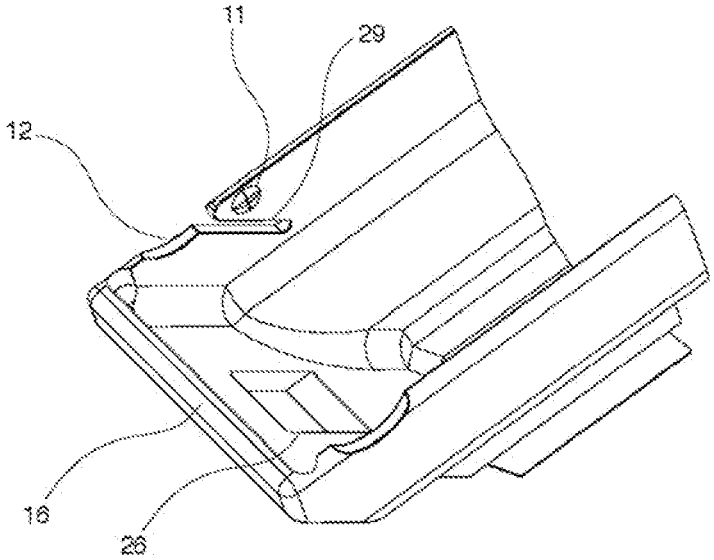
FIG. 6 is a fragmented perspective bottom view of the rear of an alternate embodiment of the adjustable receiver cover body.

The adjustable cover includes a principally longitudinal cover body 1 surface extending between opposite ends of the adjustable cover and encloses at least a portion of the interior of the rifle receiver while providing apertures 14, 15 (see FIG. 4) adequate for the ejection of spent cartridges, operation of a charging handle 19, and operation of a safety lever 28. As required, the lower edges of the cover body 1 may provide clearance for rivet heads fastened to the rifle receiver 30 by means of scallops 12 (see FIGS. 4 & 6) or other openings or cavities as required. A step down distance from the uppermost surface of the front mounting tab 2 to the uppermost accessory mounting surface 5 of the cover body 1 places the mounting surface as near as possible to the rifle barrel bore centerline.

Placing the mounting surface 5 as low and near the barrel bore centerline as possible facilitates the ability to simultaneously co-witness the standard iron sight aiming device through the lens of an optical aiming device. Furthermore, the low mounting surface 5 creates greater space for optic options and is desirable for enhancing the ergonomic relationship between the rifle buttstock 20, the iron sights, optic aiming devices, and the operator while aiming. The relationship of the mounting surface 5 to the rifle barrel bore centerline is controlled by the relative distances between the transverse hinge pin hole 17 (see FIG. 1) of the front tab 2 as installed to the rear sight block 9 of the rifle, the rear bottom edge 16 (see FIG. 3) of the cover body 1 which bears upon the rear trunnion 13 of the rifle, and the size of the step down distance between the front tab 2 and the mounting surface 5. In one embodiment the upper mounting surface 5 of the cover body 1 integrally forms an optic and accessory mounting interface over the majority of the cover body 1 length of the type commonly known to those skilled in the art as a MIL-STD-1913 Picatinny rail.

In an alternate embodiment the mounting interface surface 5 may be mechanically affixed to the separate adjustable cover body surface 1 by fasteners, bonding, mechanical interference or other convenient method known to those skilled in the art.

The adjustable cover includes a longitudinally adjustable front mounting tab 2 (FIG. 1) affixed to the cover body 1 by means of screws 31 passing through one or more longitudinal slots with counterbore 21 in the front mounting tab 2. The counterbore of slot 21 minimizes the visual obstruction caused by the screw 31 heads while aiming. The front mounting tab 2 is positively aligned with respect to the cover body 1 by means of a raised key 22 on the underside of the tab 2 and a corresponding precisely fitting groove 23 on the cover body 1. The key 22 and groove 23 are of sufficient width and depth to provide adequate alignment and guidance to the corresponding parts while preventing interference with screw holes 24. The groove in the cover body 1 is comprised of a flat or substantially planar bottom surface and with sides disposed on either side of the longitudinal axis and perpendicular to the groove 23 bottom.

The front mounting tab 2 is installed to the rear sight block 9. When the adjustable cover is fitted in replacement of a conventional receiver cover 6 it is attached in place of a standard tangent type rear sight leaf (not shown). The front mounting tab 2 incorporates a transverse hole 17 at the forward end for accepting a hinge pin 3 (see FIG. 1-3) for attachment of the adjustable cover to the rear sight block 9 of the rifle through the existing mounting hole for the standard tangent type leaf sight. The hinge pin 3 may be retained to the rear sight block 9 in the rifle assembly by a clip fitted to a groove, a pin passing through a cross drilled hole, a pressed on sleeve, a threaded nut assembled onto a threaded end, or by any other means commonly known to those skilled in the art. In plan view, the width of the forward end of the mounting tab 2 at the location of the hinge pin hole 17 provides a minimum clearance to the corresponding space between the retaining side walls at the point of attachment to the rear sight block 9 thereby minimizing shift and inaccuracy of the optic device during rifle handling and firing.

In an alternate embodiment the key 22 and groove 23 may take the commonly known shape of a dovetail key and groove, T-Slot key and groove, or other such fitting and aligning method as commonly known to those skilled in the art. In the case of construction with the alternate embodiment of key 22 and groove 23 design the fitment between the cover body 1 and the forward tab 2 may be of a press fit engagement thereby obviating the need for additional fasteners and related fastener slots and holes between said components.

In another alternate embodiment the front mounting tab 2 is formed integrally with the cover body 1 and adjustability for rifle variance is limited to the variable placement of the lower rear edge 16 (FIG. 3) within a receiving groove in rear trunnion 13.

In a further alternate embodiment the front mounting tab 2 is formed integrally with the cover body 1 and the transverse hole 17 of the front tab is replaced with a transverse slot thereby providing longitudinal adjustment of the replacement cover at the hinge pin while preventing vertical and lateral movement relative to the rifle.

Figure 5:
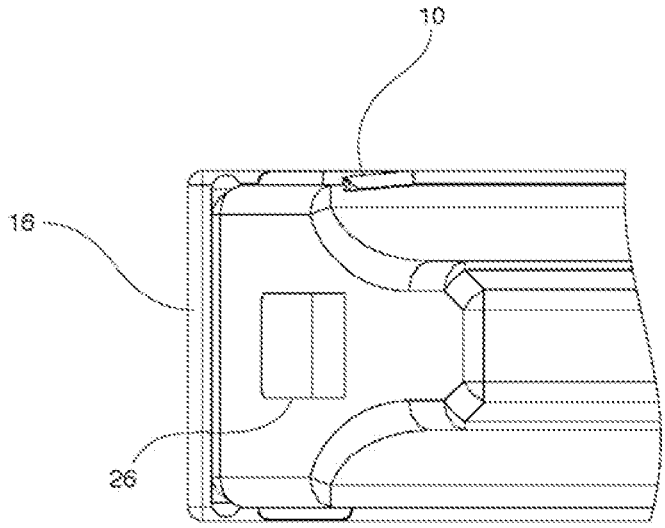
FIG. 5 is a fragmented bottom view of the rear end of the adjustable receiver cover body.

A self centering characteristic of the adjustable cover is achieved by employing the material resiliency of one side panel of the cover body 1 as a flexible spring generally pressed against the outer surface of the rifle receiver 30 and employing the opposite side panel of the cover body as a fixed anchor point pressed against the receiver and establishing a repeatable lateral location relative to the rifle receiver. Spring tension and location of the such used side panel is achieved by providing at least one slot 29 (FIGS. 2-4, & 6), opening, flexure, or combination thereof on either side of a protrusion 10 (FIG. 5) from the inner surface of the spring side panel and thereby controlling the length and force of spring to a desired location and magnitude. The inner surface protrusion 10 of the springing side panel makes contact with an outer side wall of the rifle receiver 30 thereby causing an outward flexing of the spring panel and thusly drawing the opposite side panel inner surface of the cover body 1 against the rifle receiver 30. In one embodiment the protrusion 10 is formed by an inward bend in the proximate panel area of slot 29, but may be positioned anywhere within the springing section of panel. The amount of force exerted upon the rifle receiver 30 by the springing side panel may be increased or decreased by a corresponding increase or decrease in the size of the protrusion 10.

In an alternate embodiment of the subject matter the protrusion may take any other form such as but not limited to a button head 11 (FIG. 6) and be integrally produced by casting, machining, forming, pressing, or other method commonly known to those skilled in the art.

In another alternate embodiment, the protrusion 11 may be produced separately and attached by fastening, interference fit, bonding, welding, or other method commonly known to those skilled in the art.

Figure 8:
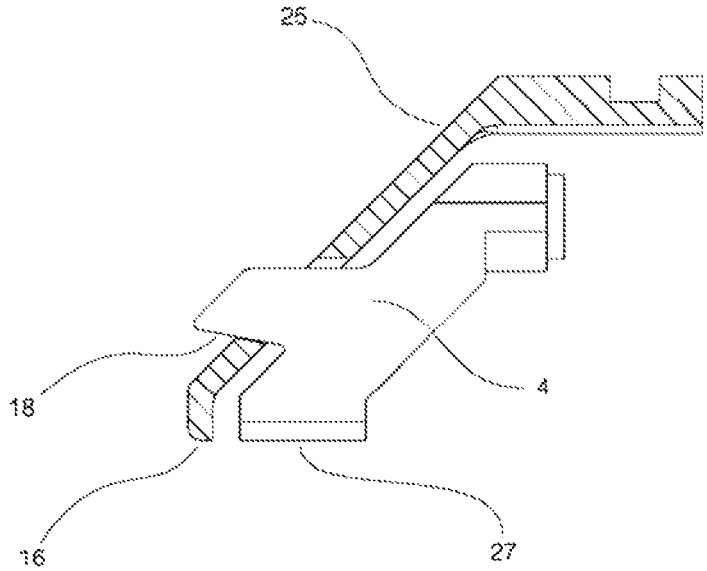
FIG. 8 is a right side elevation sectional view of the rear of the adjustable receiver cover body showing the relationship to the release button.

The back panel 25 of the cover body 1 encloses the rear end of the adjustable cover and is generally angled forward toward the front end of the rifle to reduce material requirement and weight, but may also be of construction generally vertical or perpendicular to the barrel bore centerline. The back panel 25 incorporates a hole 26 of generally rectangular shape, but which may be of any shape, allowing the passage of the cover release button 4, hereinafter described, through said back panel. The bottom edge of hole 26 may have an angle 18 (FIG. 8) to match the cam surface of release button 4, may be of rounded cross section, or generally flat and parallel to the mounting surface 5 of the adjustable cover.

Figure 3:
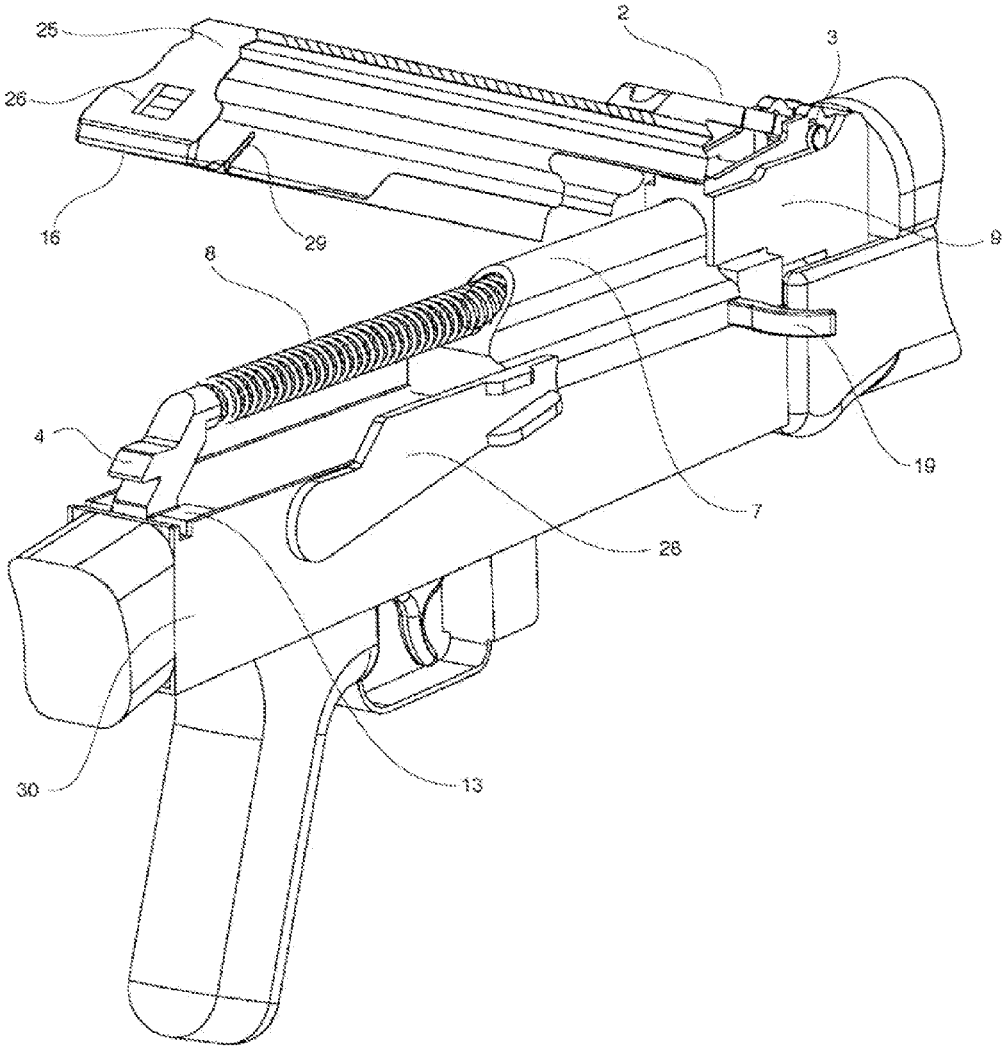
FIG. 3 is a fragmented perspective view of an AK-47 type rifle with an attached example of the adjustable receiver cover pivotally opened to reveal the interior of the rifle as viewed from the right rear.
Figure 7:
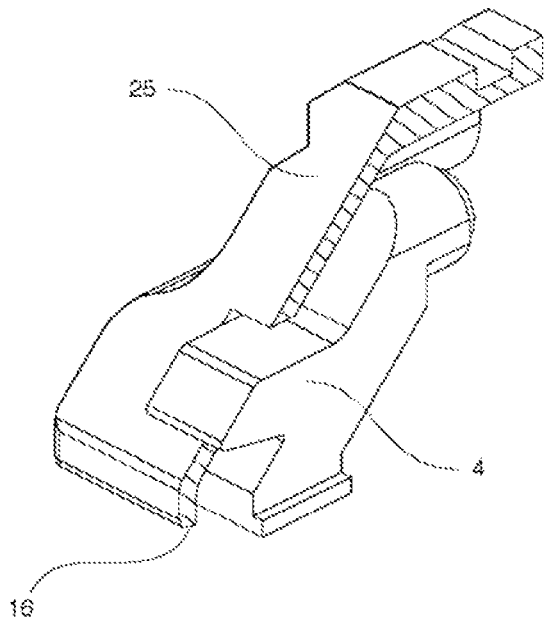
FIG. 7 is a perspective sectional view of the rear of the adjustable receiver cover body showing the relationship to the release button.

The cover release button 4 is vertically and laterally restrained, and longitudinally free to move by fitment into a longitudinal mounting slot (not shown) in the rear trunnion 13 (FIG. 3) of the rifle in the conventional method. FIG. 7 illustrates a perspective cross section of the relationship between the release button 4 and back panel 25 of the adjustable cover. The release button exerts a continuous rearward force against the back panel 25 as a result of the attachment to and force applied by a spring 8 (FIG. 3). As the release button 4 is driven rearward by the spring 8, the underside 18 (FIG. 8) of the release button 4 which has an angle relative to the base surface 27 of said button and to the direction of travel, acts as a cam interfacing with the bottom edge of hole 26 thereby drawing the cover body 1 against the rear trunnion 13. Furthermore, as the rifle is fired and the bolt carrier is driven rearward in the conventional manner, the spring 8 is compressed and thereby increases the driving force upon the release button 4 and increasing the cam action clamping force upon the cover body 1 precisely when needed most as a result of vibration resulting from said firing. When the adjustable cover subject matter is fitted to a rifle in replacement of a pre-existing conventional receiver cover 6, the release button 4 with integral cam surface 18 is a direct replacement for a conventional release button (not shown) as normally supplied with the rifle and which lacks a cam surface.

In an alternate embodiment, the back panel 25 may be of separate construction and attached to the cover body 1 by use of fasteners, bonding, welding, interference fit, or other convenient method commonly known to those skilled in the art.

In another alternate embodiment the rear cam locking release button 4 is replaced with a latch mechanism and the conventional cover release button supplied with the rifle is retained. The latch mechanism is affixed to the cover body. In this embodiment the latch mechanism attached to the cover body engages a bottom surface of the conventional release button to draw the replacement cover down upon the rear trunnion of the rifle.

Other embodiments of the subject matter may be readily devised by those skilled in the art which will embody the principles of the subject matter and fall within the spirit and scope thereof. It is to be understood that the subject matter is not limited to the specific features shown and described since the means herein disclosed comprise only some of the forms of putting the subject matter into effect. The above detailed description constitutes only some of the preferred embodiments. The subject matter is, therefore, claimed in any of its forms or modifications within the proper scope of the claims.

I claim:

1. A firearm, comprising:

a receiver; and a cover coupled to the receiver, the cover comprising:

a cover body that co s a portion of the receiver;

an accessory mounting surface coupled to the cover body;

a front mounting tab with a step down from an uppermost surface of the front mounting tab to an uppermost surface of the cover body, configured to fit against the firearm and pivotably attach the cover to the receiver;

a spring coupled to the cover body configured to contact a side of the receiver, thereby reducing movement of the cover body relative to the receiver; and a locking apparatus for securely fixing a rear end of the cover body to the receiver.

2. The firearm of claim 1, the spring comprising an inward protrusion from a side panel of the cover body making contact with the rifle receiver thereby exerting a force upon the receiver which is opposed by an opposite panel.

3. The firearm of claim 1, the cover body comprising a first slot adjacent to an inward protrusion thereby isolating movement of the spring.

4. The firearm of claim 3, the cover body further comprising a cover release button which is laterally and vertically restrained by a second slot in the receiver and is driven rearward by spring pressure thereby causing a surface of the release button to interact with a corresponding surface of the cover body to draw said cover body against the receiver and thereby reduce movement relative to the receiver.

5. The firearm of claim 1, wherein the front mounting tab is adjustably attached to the cover body by a plurality of fasteners.

6. The firearm of claim 1, wherein the front mounting tab is an integral part of the cover body.

7. The firearm of claim 1, the locking apparatus comprising a cam.

8. The firearm of claim 1, wherein the firearm is a rifle.

9. The firearm of claim 1, wherein the firearm is a pistol.

10. The firearm of claim 1, wherein the accessory mounting surface is an integral part of the cover body.

11. The firearm of claim 1, wherein the spring is an integral part of the cover body.

12. An apparatus, comprising:

a cover body for covering a portion of a receiver of a firearm;

an accessory mounting surface coupled to the cover body;

a front mounting tab with a step down from an uppermost surface of the front mounting tab to an uppermost surface of the cover body, configured to fit against the firearm and pivotably attach the cover to the receiver;

a spring coupled to the cover body configured to contact a side of the receiver, thereby reducing movement of the cover body relative to the receiver; and a locking apparatus for securely fixing a rear end of the cover body to the receiver.

13. The apparatus of claim 12, the spring comprising an inward protrusion from a side panel of the cover body making contact with the rifle receiver thereby exerting a three upon the receiver which is opposed by an opposite panel.

14. The apparatus of claim 12, the cover body comprising a first slot adjacent to an inward protrusion thereby isolating movement of the spring.

15. The apparatus of claim 14, the cover body further comprising a cover release button which is laterally and vertically restrained by a second slot in the receiver and is driven rearward by spring pressure thereby causing a surface of the release button to interact with a corresponding surface of the cover body to draw said cover body against the receiver and thereby reduce movement relative to the receiver.

16. The apparatus of claim 12, wherein the front mounting tab is adjustably attached to the cover body by a plurality of fasteners.

17. The apparatus of claim 12, wherein the front mounting tab is an integral part of the cover body.

18. The apparatus of claim 12, the locking apparatus comprising a cam.

19. The apparatus of claim 12, wherein the firearm is a rifle.

20. The apparatus of claim 12, wherein the firearm is a pistol.

21. The apparatus of claim 12, wherein the accessory mounting surface is an integral part of the cover body.

22. The apparatus of claim 12, wherein the spring is an integral part of the cover body.

* * * * *